US008939629B2

(12) United States Patent
Chu et al.

(10) Patent No.: US 8,939,629 B2
(45) Date of Patent: Jan. 27, 2015

(54) LIGHTING DEVICE

(76) Inventors: Wei-Cheng Chu, Taipei (TW); Eden Chou, Taipei (TW); Fu-Ting Cheng, Taipei (TW); Kuan-Chun Ni, Taoyuan County (TW); Chung-Tong Ho, Taichung (TW)

( * ) Notice: Subject to any disclaimer, the term of this patent is extended or adjusted under 35 U.S.C. 154(b) by 256 days.

(21) Appl. No.: 13/561,110

(22) Filed: Jul. 30, 2012

(65) Prior Publication Data

US 2014/0029291 A1 Jan. 30, 2014

(51) Int. Cl.
*F21V 33/00* (2006.01)

(52) U.S. Cl.
USPC ..... 362/565; 362/332

(58) Field of Classification Search
CPC ..... F21V 33/00
USPC ..... 362/565, 363, 382, 431, 433, 458, 806
See application file for complete search history.

(56) References Cited

U.S. PATENT DOCUMENTS

| | | | | |
|---|---|---|---|---|
| 7,988,322 | B2 * | 8/2011 | Zheng | 362/218 |
| 2003/0016544 | A1 * | 1/2003 | Huang | 362/565 |
| 2003/0174515 | A1 * | 9/2003 | Huang | 362/551 |
| 2004/0190309 | A1 * | 9/2004 | Bixler et al. | 362/565 |
| 2005/0174799 | A1 * | 8/2005 | Tseng | 362/565 |
| 2005/0231975 | A1 * | 10/2005 | Bixler et al. | 362/565 |

* cited by examiner

*Primary Examiner* — Elmito Breval

(57) ABSTRACT

The lighting device includes a rod and two or more lighting units superimposing each other. Each of the lighting units includes a housing and a lighting element. The housing has a through hole, a first conductive element, a second conductive element and a positioning mechanism. The through hole is penetrated by the rod so that the housing can turn about the rod. The positioning mechanism limits the lighting units to turn between a first position and a second position. The first conductive elements and second conductive elements of the lighting units make contact at the second position, respectively.

11 Claims, 6 Drawing Sheets

LIGHTING DEVICE

BACKGROUND OF THE INVENTION

1. Technical Field

The invention relates to lighting devices, particularly to variable lighting devices.

2. Related Art

Lighting devices are necessary in our daily life. A lighting device serves as not only an illuminator but also ornamentation. Most lighting devices are turned on/off by a switch. Such a control manner is too tame or draggy for ornamental lighting devices. On the other hand, conventional lighting devices are unvarying in shape. For ornamental lighting devices, this is not good enough, too.

SUMMARY OF THE INVENTION

An object of the invention is to provide a lighting device which can change in shape and can be turned on/off by the shape change.

To achieve the above object, the lighting device of the invention includes a rod and two or more lighting units superimposing each other. Each of the lighting units includes a housing having a through hole, a first conductive element, a second conductive element and a positioning mechanism. The through hole is penetrated by the rod so that the housing can turn about the rod. The positioning mechanism limits the lighting units to turn between a first position and a second position. The first conductive elements and second conductive elements of the lighting units make contact at the second position, respectively.

DETAILED DESCRIPTION OF THE INVENTION

Figure 1:
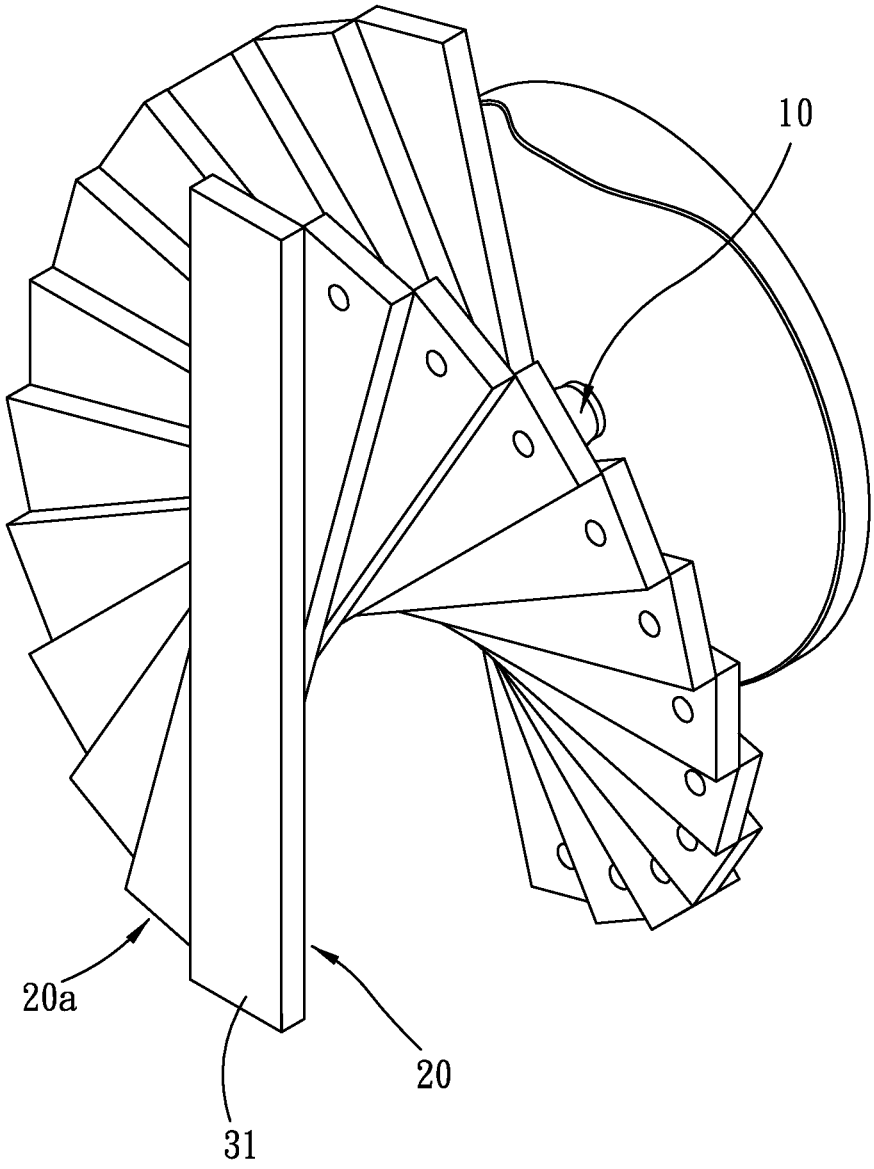
FIG. 1 is a perspective view of the first embodiment of the invention.
Figure 6:
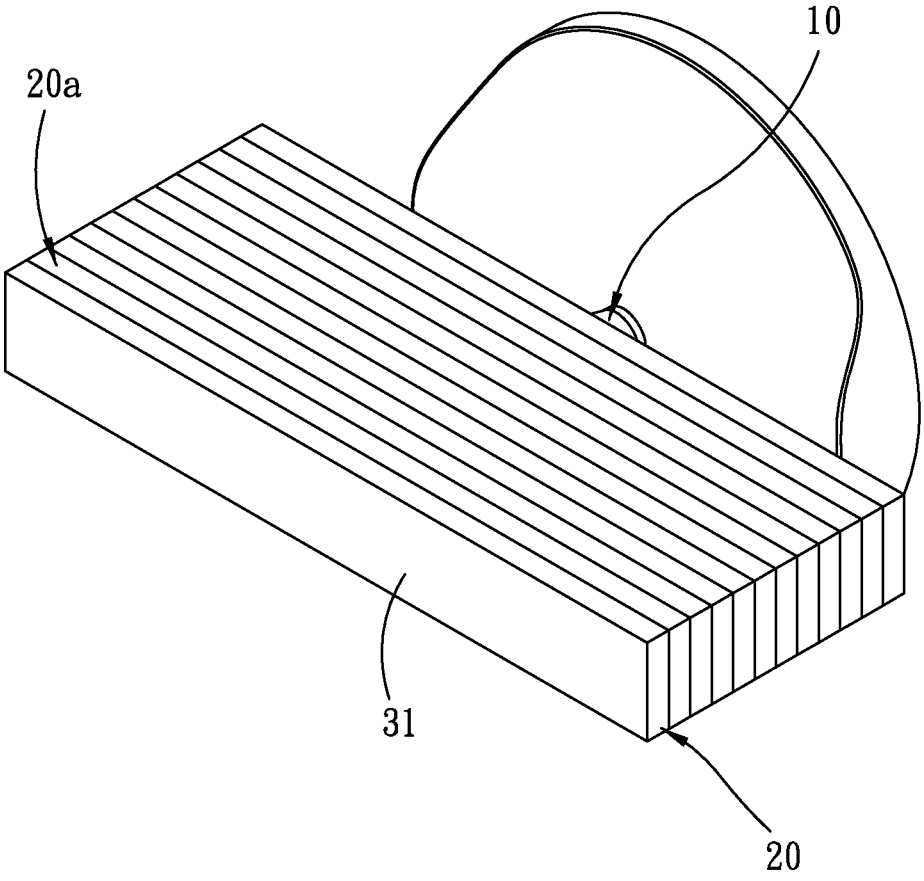
FIG. 6 is a schematic view showing the lighting units at the first position.

Please refer to FIG. 1. The lighting device of the invention includes a rod 10 and at least two lighting units 20, 20*a*. The rod 10 has a wire (not shown) for connecting electric power source. The lighting units 20, 20*a* superimpose each other and turn about the rod 10 between a first position (as shown in FIG. 6) and a second position (as shown in FIG. 1) to form a shape-variable lighting device.

In an embodiment of the invention, the first position means the lighting units 20, 20*a* align with each other (i.e., in a status of complete superposition) and the second position means the lighting units 20, 20*a* do not align with each other (in a status of incomplete superposition).

Figure 5:
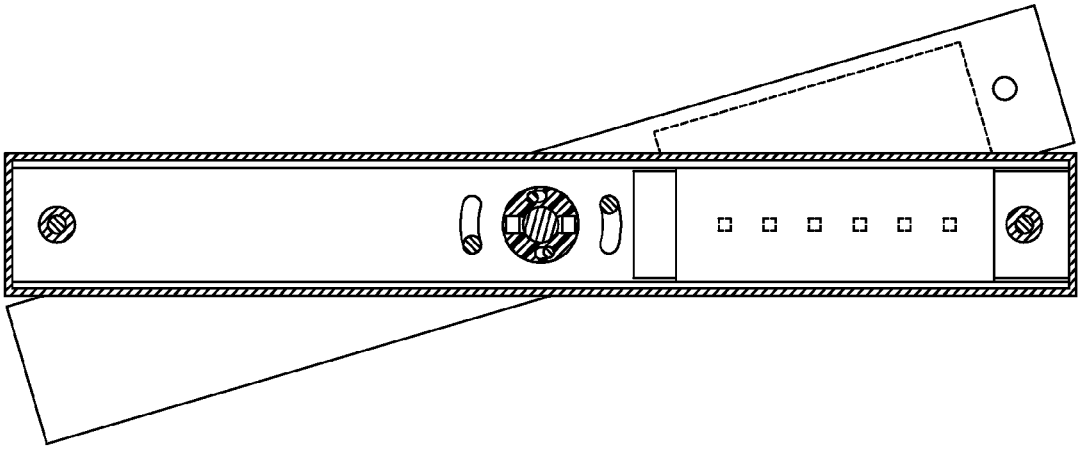
FIG. 5 is a schematic view showing the lighting units at the second position.

As shown in FIG. 5, each of the lighting units 20, 20*a* includes a housing 30 and a lighting element 40. The housing 30 has a through hole 50, a first conductive element E11, a second conductive element E12 and a positioning mechanism.

Figure 2:
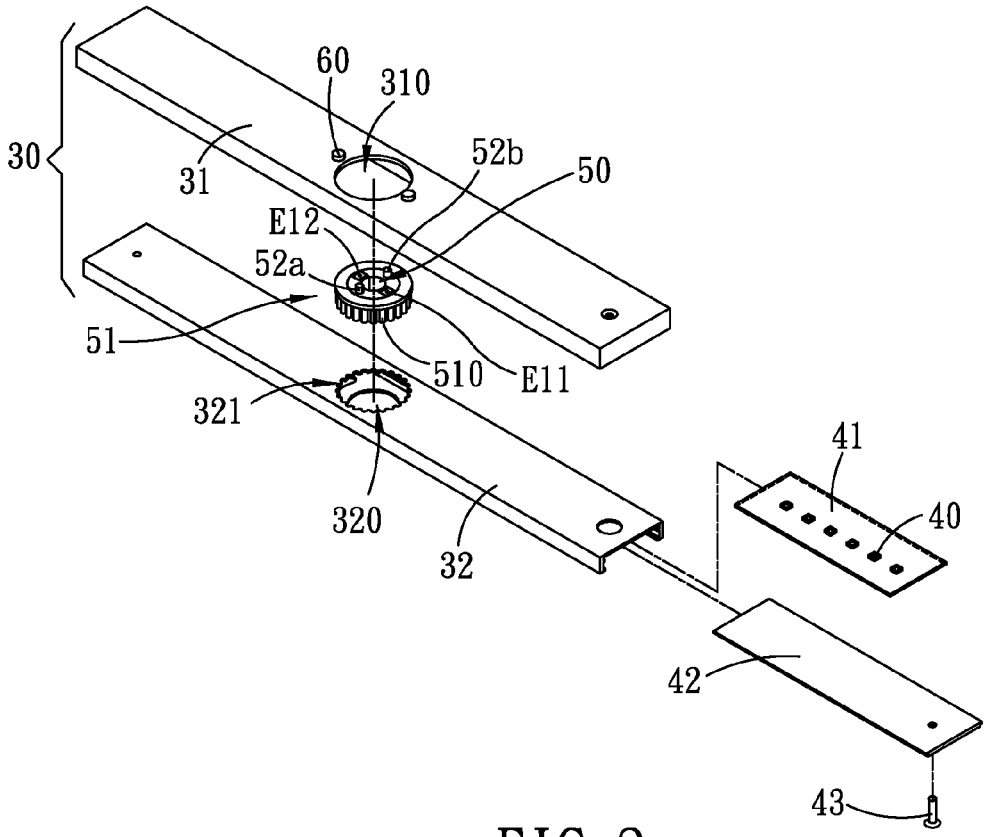
FIG. 2 is an exploded view of the first embodiment of the invention.

Please refer to FIG. 2. The lighting element 40 is mounted on a circuit board 41 and may be a light-emitting diode (LED), small bulb, LED array or fluorescent tube. The number of the lighting element 40 can be one or more. The lighting element 40 is electrically connected to the first conductive element E11 and the second conductive element E12 through the circuit board 41.

As shown in FIG. 2, the housing 30 includes an upper cover 31 made from transparent or opaque material and a lower cover 32 made by aluminum extrusion. The circuit board 41 is fastened to the lower cover 32 and a light-permissible plate 42 is disposed over the lighting element 40.

Figure 3:
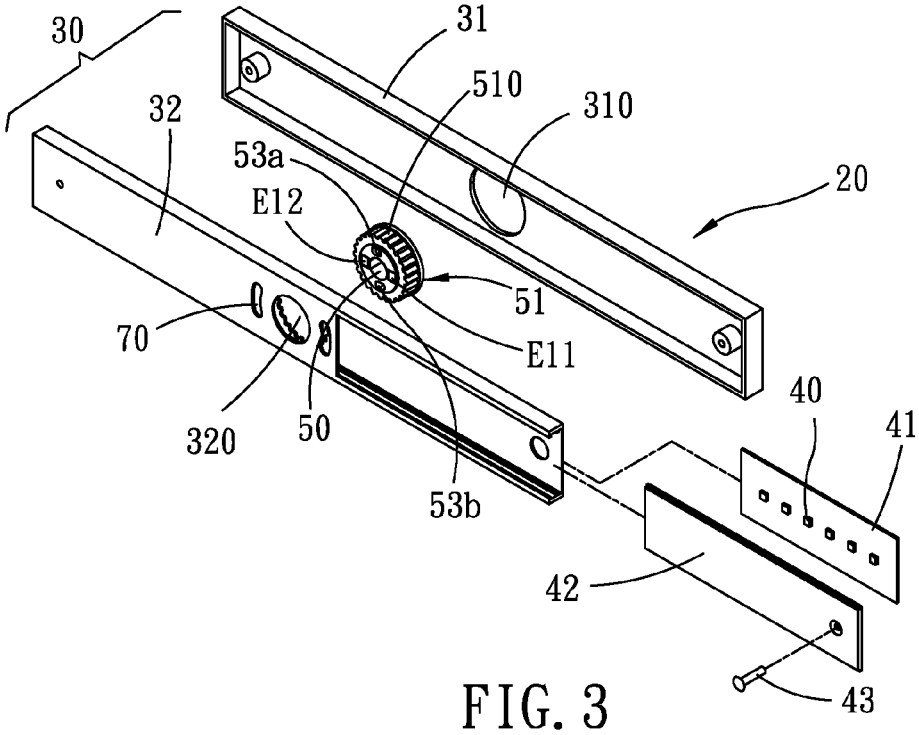
FIG. 3 is another exploded view of the first embodiment of the invention.

The through hole 50 is penetrated by the rod 10 so that the lighting units 20, 20*a* can turn about the rod 10. The through hole 50 is formed in a sleeve 51. The upper cover 31 and lower cover 32 are formed with an upper through hole 310 and a lower through hole 320, respectively. An edge of the lower through hole 320 is formed with a toothed portion 321. A periphery of the sleeve 51 is formed with a toothed surface 510 corresponding to the toothed portion 321. The top of the sleeve 51 is formed with two inserts 52*a*, 52*b* and the bottom of the sleeve 51 is formed with two inserting holes 53*a*, 53*b* as shown in FIG. 3. The sleeve 51 is received in the lower through hole 320 and the lower cover 32 and the light-permissible plate 42 are fastened to the upper cover 31 with screws.

In the shown embodiment, the through hole 50 is located at the centers of the lighting units 20, 20*a*, but other positions are also available.

The first conductive element E11 and the second conductive element E12 can be electrically connected to the lighting element 40 by a contact position or through the sleeve 51.

Figure 4:
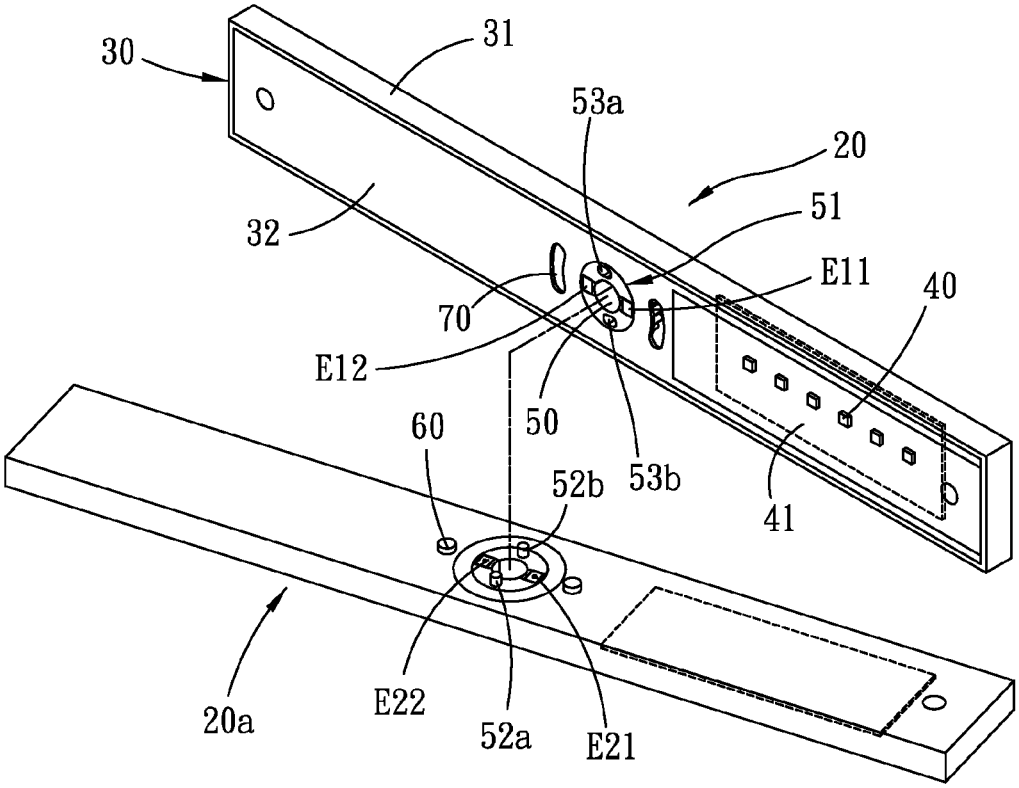
FIG. 4 is a schematic view showing the connective relationship between the lighting units.

As shown in FIG. 2, the first conductive element E11 and the second conductive element E12 are separately located at two opposite sides of the through hole 50. The first conductive element E11 and the second conductive element E12 form four contacts on the top and bottom of the sleeve 51. When the lighting units 20, 20*a* is at the second position, the first conductive elements E11, E21 of the lighting units 20, 20*a* are in contact with each other and the second conductive elements E12, E22 of the lighting units 20, 20*a* are in contact with each other as shown in FIG. 4.

As shown in FIG. 5, when a lighting unit 20*a* is turned to the second position, the first conductive elements E11, E21 of the lighting units 20, 20*a* are in contact with each other and the second conductive elements E12, E22 of the lighting units 20, 20*a* are in contact with each other. At this time, the lighting element 40 of the lighting unit 20*a* can be powered and lit up through the first and second conductive elements E11, E12 of the lighting unit 20.

Please refer to FIGS. 2 and 3. The positioning mechanism includes a bar 60 and an arcked slot 70 which is centered at the rod 10. The bar 60 protrudes from one side of the housing 30 (e.g. the upper cover 31) and the arcked slot 70 is located on the other side of the housing 30 (e.g. the lower cover 32). The bar 60 of the lighting unit 20 will enter the arcked slot 70 of the neighbor lighting unit 20*a* when the two lighting units 20, 20*a* superimpose each other. Thus the positioning mechanism can limit the lighting units 20, 20*a* to turn about the rod and between the first position and the second position defined by the arcked slot 70.

When the lighting unit 20 is powered through the rod 10, the lighting element 40 will be lit up, and the other lighting unit 20*a* can be switched by rotating to the second position or not. A user may select to make one, some or all the lighting units 20, 20*a* light up.

Figure 8:
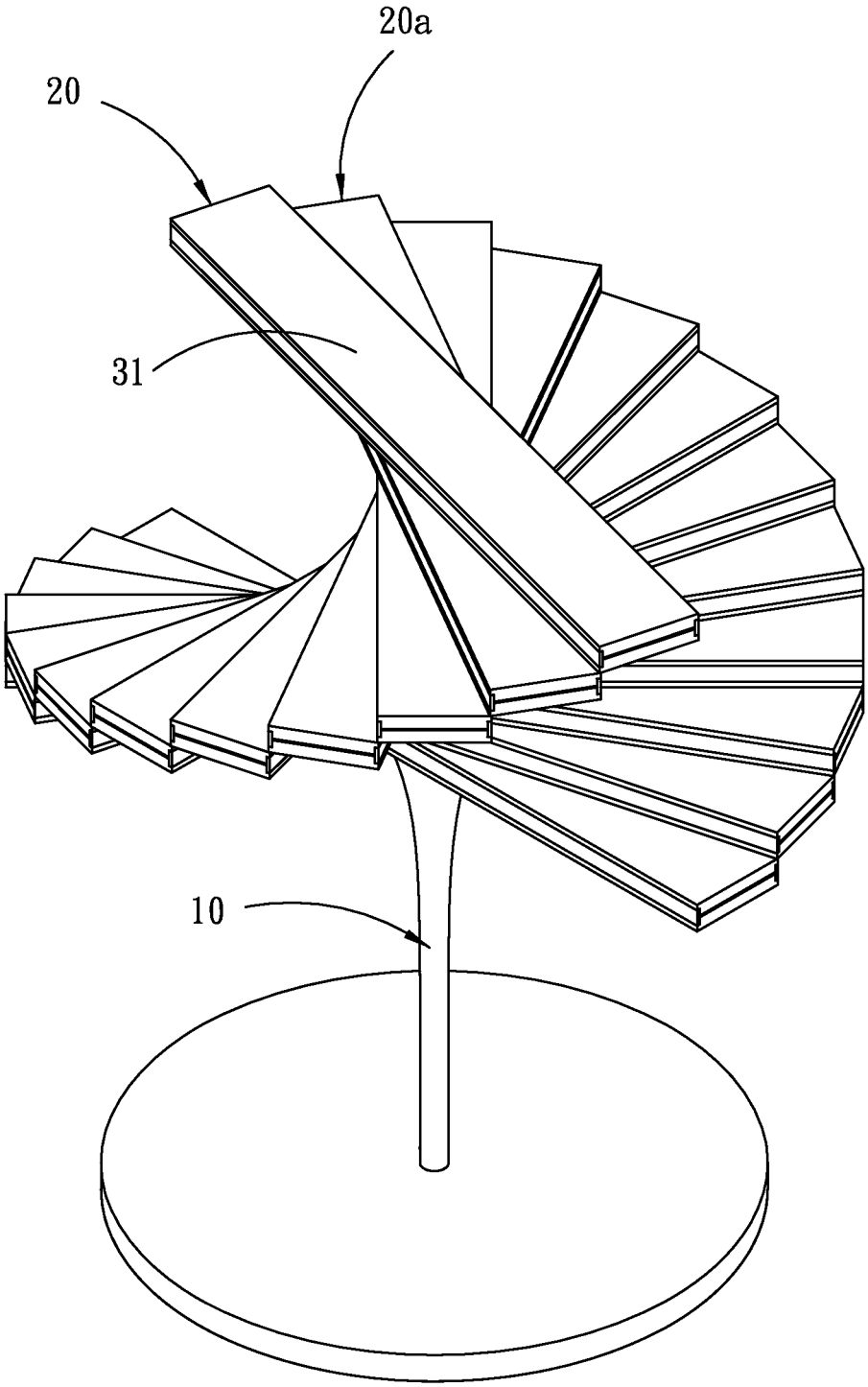
FIG. 8 is a perspective view of the second embodiment of the invention.

The lighting device of the invention can serve as a wall lamp as shown in FIG. 1 or a table lamp as shown in FIG. 8. When all the lighting units 20, 20*a* are turned to the second position, it will be a lamp with a spiral shape. When all the lighting units 20, 20*a* are turned to the first position as shown in FIG. 6, it will turn off the light and show another shape.

Figure 7:
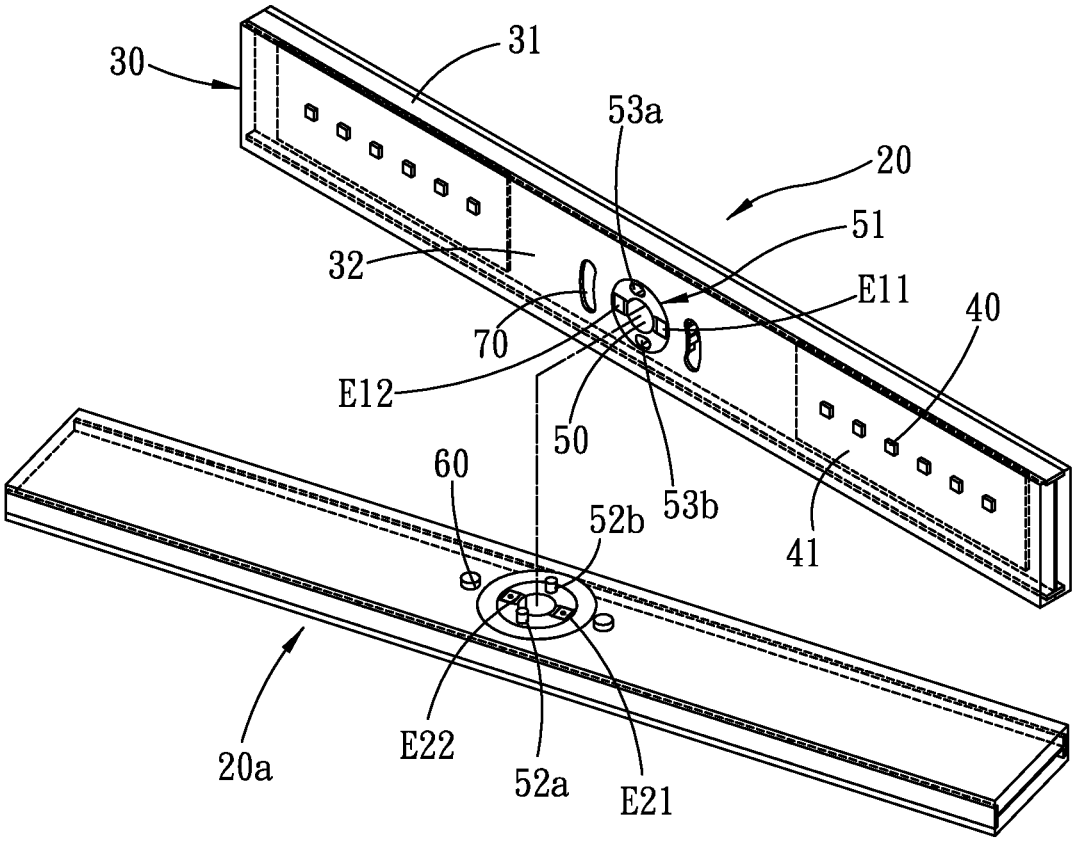
FIG. 7 is an exploded view of the second embodiment of the invention.

The lighting element 40 may be arranged on a single side or both sides of the lighting unit 20 as shown in FIGS. 2 and 7. In other words, the lighting element 40 can emit light toward the upper cover 31 or the lower cover 32.

Embodiments have been described. Nevertheless, it will be understood that various modifications may be made without departing from the spirit and scope of the embodiments. Although an application of the method has been described, it should be recognized that numerous other applications are contemplated. Accordingly, other embodiments are within the scope of the following claims.

What is claimed is:

1. A lighting device comprising:

a rod; and at least two lighting units superimposing each other, each of the at least two lighting units comprising:

a housing, having a through hole, a first conductive element, a second conductive element and a positioning mechanism, a lighting element, disposed in the housing, and electrically connecting the first and second conductive elements;

wherein the through hole is penetrated by the rod so that the housing can turn about the rod, the positioning mechanism limits the at least two lighting units to turn between a first position and a second position, and the at least two lighting units light the lighting element, the first conductive elements of the at least two lighting units make contact at the second position, and the second conductive elements of the at least two lighting units make contact other at the second position;

wherein the rod penetrates centers of the at least two lighting units.

2. The lighting device of claim 1, wherein the at least two lighting units align each other at the first position and do not align at the second position.

3. The lighting device of claim 1, wherein the housing comprises an upper cover and a lower cover, the through hole is penetrated by the rod, the through hole is formed in a sleeve, and the upper cover and lower cover are formed with an upper through hole and a lower through hole respectively.

4. The lighting device of claim 3, wherein an edge of the lower through hole is formed with a toothed portion, a periphery of the sleeve is formed with a toothed surface corresponding to the toothed portion.

5. The lighting device of claim 3, wherein the lighting element is mounted on a circuit board fastened to the lower cover, and a light-permissible plate is disposed over the lighting element.

6. The lighting device of claim 3, wherein the first conductive element and the second conductive element are separately located at two opposite sides of the through hole, the first conductive element and the second conductive element form four contacts on a top and bottom of the sleeve.

7. The lighting device of claim 3, wherein the positioning mechanism comprises a bar and an arcked slot which is centered at the rod, the bar protrudes from one side of the housing and the arcked slot is located on the other side of the housing, the bar of one of the at least two lighting units will enter the arcked slot of the other one of the at least two lighting units when the at least two lighting units superimpose each other.

8. The lighting device of claim 3, wherein a top of the sleeve is formed with two inserts and a bottom of the sleeve is formed with two inserting holes, the sleeve is received in the lower through hole.

9. The lighting device of claim 1, wherein the lighting element is located on a single side of each of the at least two lighting units.

10. The lighting device of claim 1, wherein the lighting element is more than one in number.

11. The lighting device of claim 10, wherein the lighting elements are located on two opposite sides of each of the at least two lighting units.

* * * * *